US005653623A

United States Patent [19]

Kimura et al.

[11] Patent Number: 5,653,623

[45] Date of Patent: Aug. 5, 1997

[54] POLISHING APPARATUS WITH IMPROVED EXHAUST

[75] Inventors: Norio Kimura; Seiji Ishikawa, both of Tokyo; Masako Kodera, Kawasaki; Atsushi Shigeta, Kawasaki; Riichirou Aoki, Kawasaki, all of Japan

[73] Assignees: Ebara Corporation, Tokyo; Kabushiki Kaisha Toshiba, Kawasaki, both of Japan

[21] Appl. No.: 357,176

[22] Filed: Dec. 13, 1994

[30] Foreign Application Priority Data

Dec. 14, 1993 [JP] Japan ..... 5-342830

[51] Int. Cl.[6] ..... B24B 7/04; B24B 29/02

[52] U.S. Cl. ..... 451/72; 451/288; 451/290; 451/331; 451/456

[58] Field of Search ..... 451/72, 41, 285, 451/287, 288, 289, 290, 331, 451, 456, 526, 548, 550, 421

[56] References Cited

U.S. PATENT DOCUMENTS

| | | | |
|---|---|---|---|
| 3,905,273 | 9/1975 | Shook | 451/456 X |
| 4,514,936 | 5/1985 | Hurtado | 451/456 X |
| 4,680,893 | 7/1987 | Cronkhite et al. | 451/287 X |
| 4,974,370 | 12/1990 | Gosis . | |
| 5,010,692 | 4/1991 | Ishida et al. | 451/287 X |
| 5,131,192 | 7/1992 | Cheng et al. | 451/456 |

FOREIGN PATENT DOCUMENTS

| | | | |
|---|---|---|---|
| 0 335 752 | 4/1989 | European Pat. Off. . | |
| 581424 | 2/1994 | European Pat. Off. | 451/287 |
| 1106635 | 12/1955 | France | 451/287 |
| 39 08 329 | 9/1990 | Germany . | |
| 69314 | 3/1993 | Japan | 451/287 |
| 93/25347 | 12/1993 | WIPO . | |

*Primary Examiner*—Timothy V. Eley
*Attorney, Agent, or Firm*—Wenderoth, Lind & Ponack

[57] ABSTRACT

A polishing apparatus for polishing a surface of a workpiece such as a semiconductor wafer is installed in a clean room. The polishing apparatus includes a polishing section having a turntable with an abrasive cloth mounted on an upper surface thereof, a top ring for supporting the workpiece to be polished and pressing the workpiece against the abrasive cloth, a loading section for loading the workpiece to be polished onto the top ring, and an unloading section for unloading the workpiece which has been polished from the top ring. A cover covers an entire area of movement of the top ring including the polishing section, the loading section and the unloading section. An exhaust duct discharges air of an interior space of the cover to an outside of an installation space of the polishing apparatus.

9 Claims, 11 Drawing Sheets

POLISHING APPARATUS WITH IMPROVED EXHAUST

BACKGROUND OF THE INVENTION

1. Field of the Invention

The present invention relates to a polishing apparatus, and more particularly to a polishing apparatus which can be installed in a clean room.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 μm wide, it requires that surfaces on which pattern images are to be focused by a stepper be as flat as possible because the depth of focus of an optical system is relatively small.

It is therefore necessary to make the surfaces of semiconductor wafers flat for photolithography. One customary way of flattening the surfaces of semiconductor wafers is to polish them with a polishing apparatus.

Conventionally, such a polishing apparatus has not been installed in a clean room because dust particles and harmful gas are generated by a polishing operation of the polishing apparatus. Therefore, semiconductor wafers are transported into a clean room by means of a wafer carrier after they are polished by the polishing apparatus installed outside the clean room, and then the semiconductor wafers are processed to form device layers by processing apparatuses installed in the clean room.

However, as described above, high integration in a semiconductor device demands that the semiconductor wafer to be multilayer, and it is therefore necessary to make each surface of the multilayer flat for photolithography. In order to increase productivity of manufacture of the semiconductor device, it is desirable for the polishing apparatus to be installed in the clean room of a semiconductor manufacturing plant.

However, in the case where a conventional polishing apparatus is installed in the clean room, dust particles and harmful gas generated by the polishing operation pollute the air in the clean room.

Further, in such polishing apparatus, abrasive liquid is supplied from a nozzle onto an abrasive cloth attached to an upper surface of a turntable. The abrasive liquid contains abrasive material such as silicon dioxide ($SiO_2$) or cerium dioxide ($CeO_2$) having a diameter of 1 μm or less in a liquid.

Furthermore, in order to perform chemical polishing in addition to mechanical polishing, acid or alkali may be added to the abrasive liquid. In such case, acid waste gas or alkaline waste gas or mist is liable to be discharged from the polishing apparatus.

However, in the case where acid waste gas or alkaline waste gas or mist is discharged to the clean room, such gas or mist pollutes the air in the clean room and is one serious cause of lowering the yield of the semiconductor devices.

SUMMARY OF THE INVENTION

It is therefore an object of the present invention to provide a polishing apparatus which can be installed in a clean room because waste gas and mist are prevented from being scattered into the clean room.

According to the present invention, there is provided a polishing apparatus for polishing a surface of a workpiece and including: a polishing section having a turntable with an abrasive cloth mounted on an upper surface thereof, a top ring for supporting the workpiece to be polished and pressing the workpiece against the abrasive cloth, the top ring being movable vertically and horizontally, a loading section disposed adjacent to the polishing section for loading the workpiece to be polished onto the top ring, and an unloading section disposed adjacent to the polishing section for unloading the workpiece which has been polished from the top ring. A cover covers an entire area of movement of the top ring including the polishing section, the loading section and the unloading section. An exhaust duct discharges air of an interior space of the cover to an outside of an installation space of the polishing apparatus and allows the pressure of the interior space to be lower than that of said installation space.

With the above structure, inasmuch as the polishing section, and the additional working sections including the loading section and the unloading section are integrally covered with the cover, and the pressure of the working space defined in the cover is lower than that of the surrounding space dust particles, harmful gas and mist generated in the polishing section and dust particles and mist generated in the additional working sections are prevented from being scattered in the installation space of the polishing apparatus, i. e. the clean room. Further, since the entire area of movement of the top ring is covered with the cover and the pressure in the cover is lower than that of the surrounding space, abrasive liquid and particles which adhere to the top ring are prevented from being scattered in the clean room.

Further, according to one aspect of the present invention, since the entirety of the polishing apparatus is enclosed with the partition wall, the space is divided into three spaces comprising a working space defined in the cover which covers the polishing section and the additional working sections, a buffer space defined between the partition wall and the cover, and an installation space of the polishing apparatus, i.e. the clean room. The mist generated in the working space is discharged directly from the working space to the outside of the clean room. Therefore, such mist is not scattered in the buffer space and does not stick to the inner surface of the partition wall. As a result, when replacing the abrasive cloth with a new one, even if a door of the partition wall is opened and the cover is detached, the mist which has been left in the cover remains in the buffer space which is a large space and is not scattered in the clean room.

Furthermore, according to one aspect of the present invention, since the cover covers the area for performing dressing of the abrasive cloth, and air pressure in the cover is lower than that of the surrounding space, the mist generated by the dressing operation is not scattered in the clean room.

Further, according to the present invention, since the exhaust duct has an opening which is located below the abrasive cloth, a down-draft of air is formed in the cover as well as a descending current of mist. Therefore, the mist does not float and is effectively discharged from the working space to the outside of the clean room. Further, since the cover comprises a plurality of segments, the entirety of the cover is not required to be detached for maintenance, and only a few segments which are required for maintenance can be detached.

The above and other objects, features, and advantages of the present invention will become apparent from the following description of illustrative embodiments thereof in conjunction with the accompanying drawings.

DETAILED DESCRIPTION OF THE PREFERRED EMBODIMENTS

A polishing apparatus according to an embodiment of the present invention will be described below with reference to FIG. 1.

Figure 1:
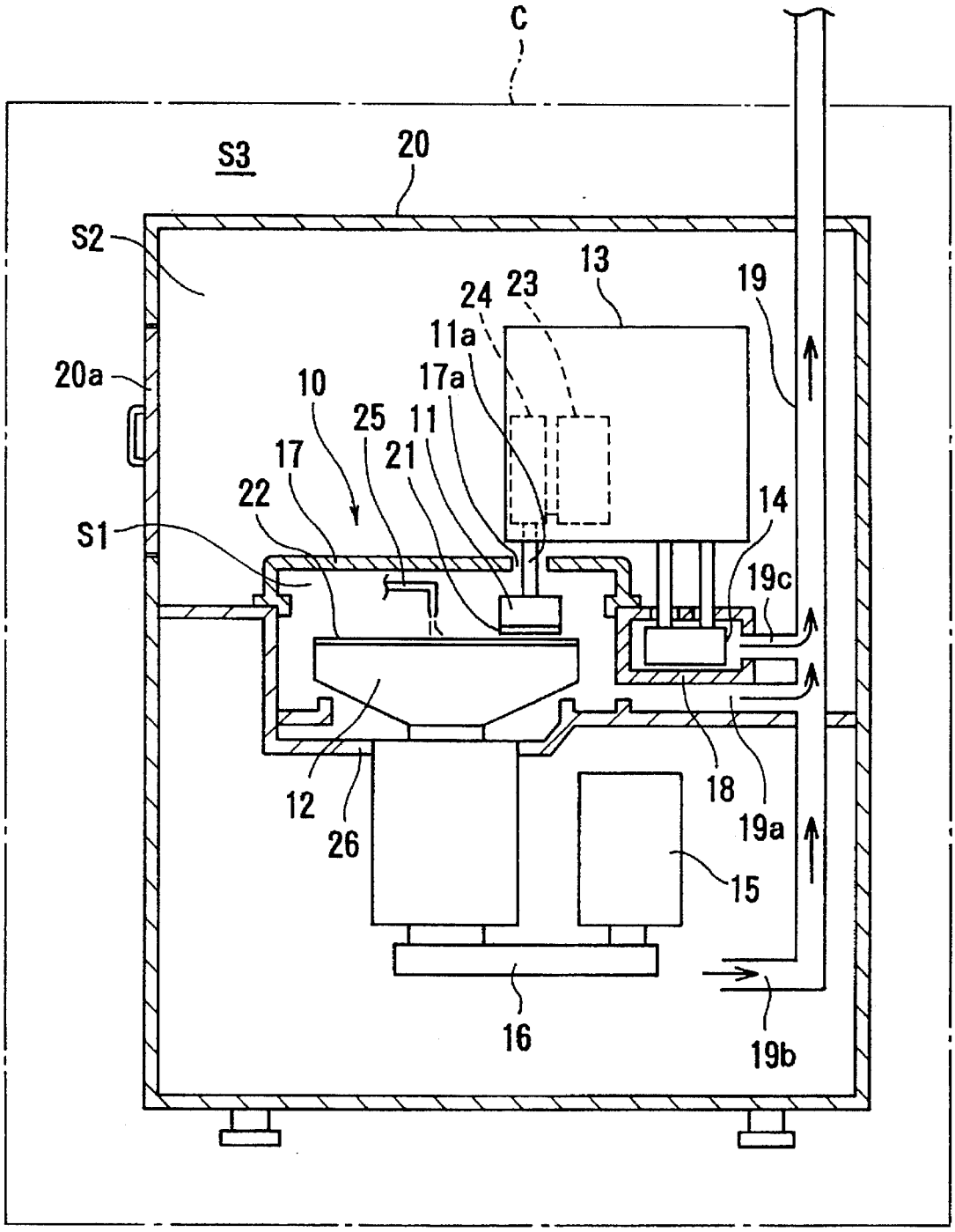
FIG. 1 is a schematic cross-sectional view of a polishing apparatus according to an embodiment of the present invention.

FIG. 1 is a schematic view showing the entire structure of the polishing apparatus of the present invention. As shown in FIG. 1, a polishing apparatus 10 is installed in a clean room C. The polishing apparatus 10 is enclosed within a partition wall 20 which prevents gas and particles generated by a polishing operation from being scattered in the clean room C.

The polishing apparatus 10 comprises a turntable 12 and a top ring 11 for holding a semiconductor wafer 21 and pressing the semiconductor wafer 21 against the turntable 12. The turntable 12 is coupled to a motor 15 through a belt 16. An abrasive cloth 22 is attached to an upper surface of the turntable 12. The top ring 11 is supported by a top ring head 13 which is provided with a top ring motor 23 for rotating the top ring 11 and an air cylinder 24 for moving the top ring 11 vertically, whereby the top ring 11 is movable up and down and is rotatable about an axis of the top ring 11. The top ring 11 is movable in a horizontal plane across the turntable 12 by a moving mechanism 14. An abrasive liquid containing abrasive material such as silicon dioxide ($SiO_2$) or cerium dioxide ($CeO_2$) is supplied from a nozzle 25 onto the upper surface of the abrasive cloth 22.

With the polishing apparatus of the above structure, the semiconductor wafer 21 is polished by pressing the semiconductor wafer 21 against the abrasive cloth 22 on the turntable 12. Since the turntable 12 and the top ring 11 are rotated during polishing, dust particles generated by the polishing operation and abrasive liquid are scattered around in a mist state due to centrifugal forces of the turntable 12 and the top ring 11.

Further, the polishing apparatus 10 of the above structure can polish various objects such as semiconductor wafers by proper selection of combinations of abrasive material and diluent. For example, in the case of polishing silicon dioxide deposited on a silicon substrate, abrasive liquid containing abrasive material consisting of colloidal silica in potassium hydroxide (KOH) solution or sodium hydroxide (NaOH) solution is typically used. In the case of polishing a metal layer such as tungsten (W) on a substrate, abrasive liquid containing nitric acid ($HNO_3$) solution or sulfuric acid ($H_2SO_4$) solution often used. Nitric acid or sulfuric acid which is often used to polish the metal layer is reacted with metal, thereby producing waste gas such as nitrogen oxide (NO) or sulfur oxide ($SO_2$). Further, since the moving mechanism 14 has slide contact members such as a ball screw, dust particles or lubricant are scattered around.

Therefore, a polishing section including the turntable 12, and the moving mechanism 14 which generate various pollutants are covered by a cover 17 and a cover 18, respectively. An exhaust duct 19 is provided to discharge air from the cover 17 and the cover 18 to the outside of the clean room C.

Figure 2:
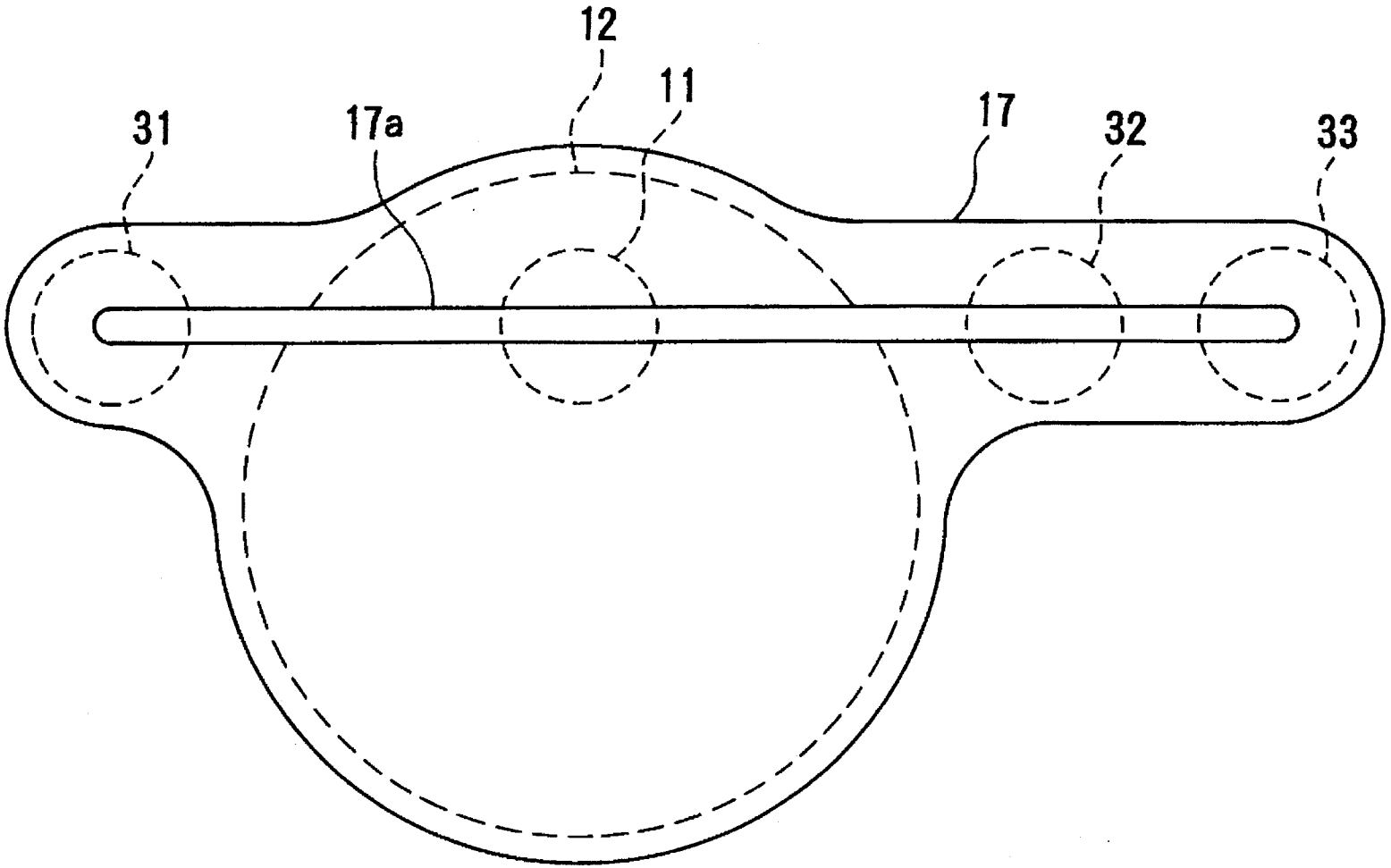
FIG. 2 is a plan view of the overall shape of a cover incorporated in the polishing apparatus of FIG. 1.

FIG. 2 shows the cover 17 which is applicable to the polishing apparatus having the top ring 11 which moves linearly across the turntable 12 from a loading section 31 to a top ring washing section 33 and an unloading section 32. The loading section 31 serves to load the semiconductor wafer 21 to be polished onto the top ring 11, the unloading section 32 serves to unload the semiconductor wafer 21 which has been polished from the top ring 11, and the top ring washing section 33 serves to wash the top ring 11 after polishing.

The cover 17 is made of transparent resin material, comprises a plurality of segments and serves to cover working sections including the loading section 31, the unloading section 32, the top ring washing section 33, and a polishing section including the turntable 12. A linear opening **17*a* is formed in the cover 17 to allow the top ring 11 to move linearly in the cover 17. The opening 17*a* has a width that is slightly larger than the outside diameter of a top ring shaft 11*a* so that the top ring 11 can be reciprocated in the cover 17 from the loading section 31 to the top ring washing section 33**.

Figure 3:
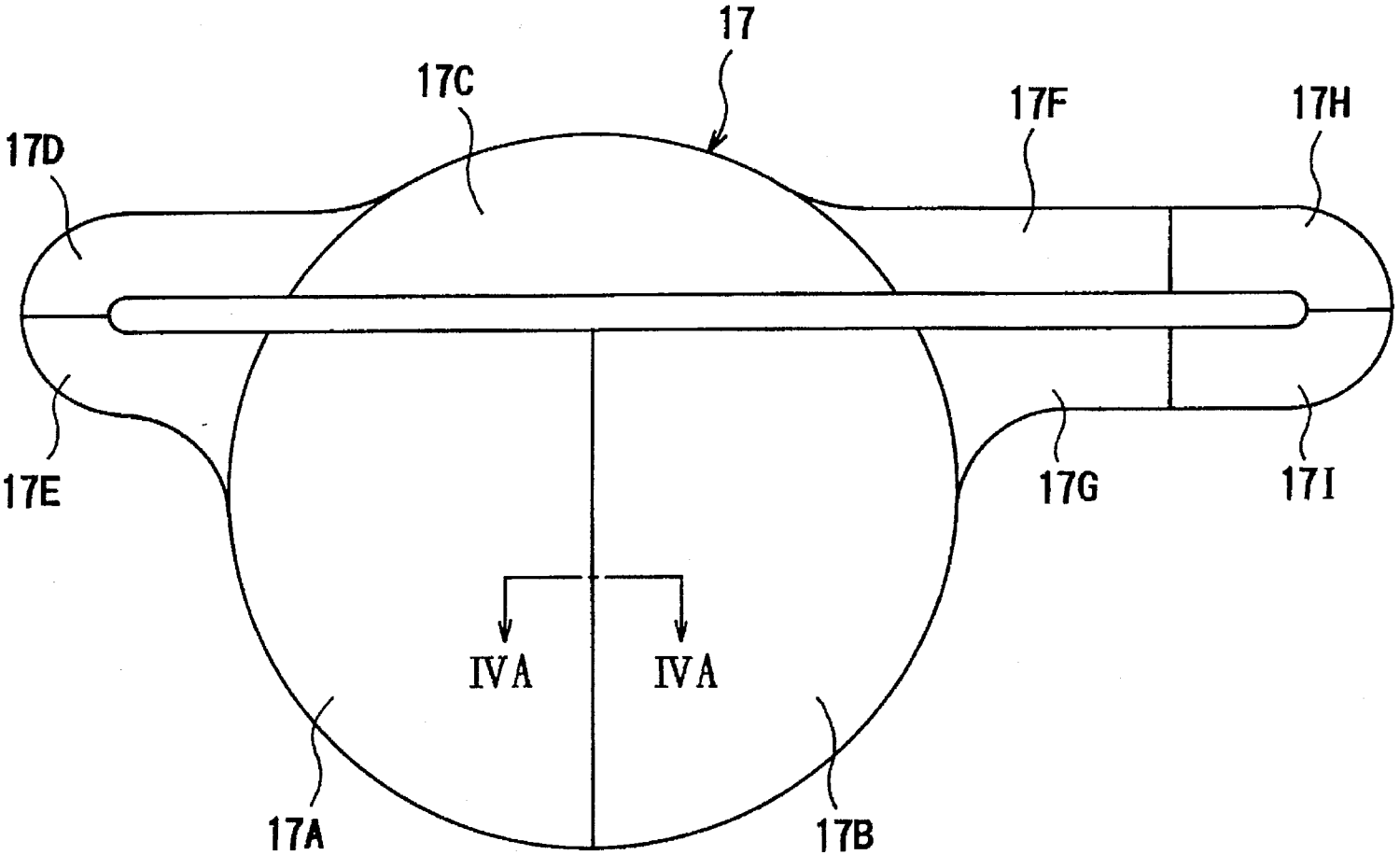
FIG. 3 is a plan view of the cover comprising a plurality of segments incorporated in the polishing apparatus of FIG. 1.
Figure 4A:
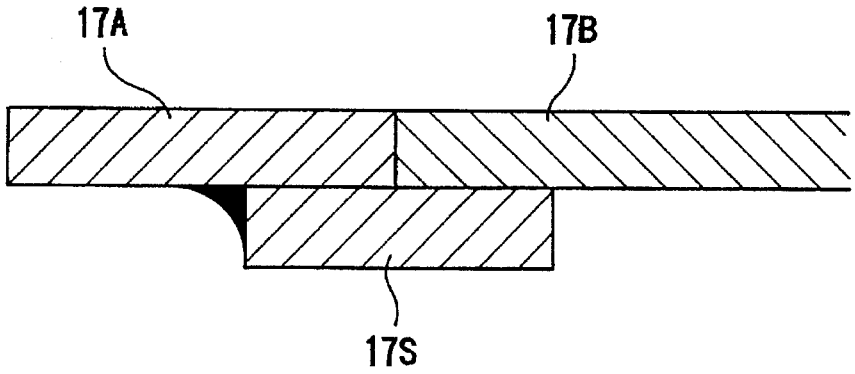
FIG. 4A is a cross-sectional view taken along line IVA—IVA of FIG. 3.
Figure 4B:
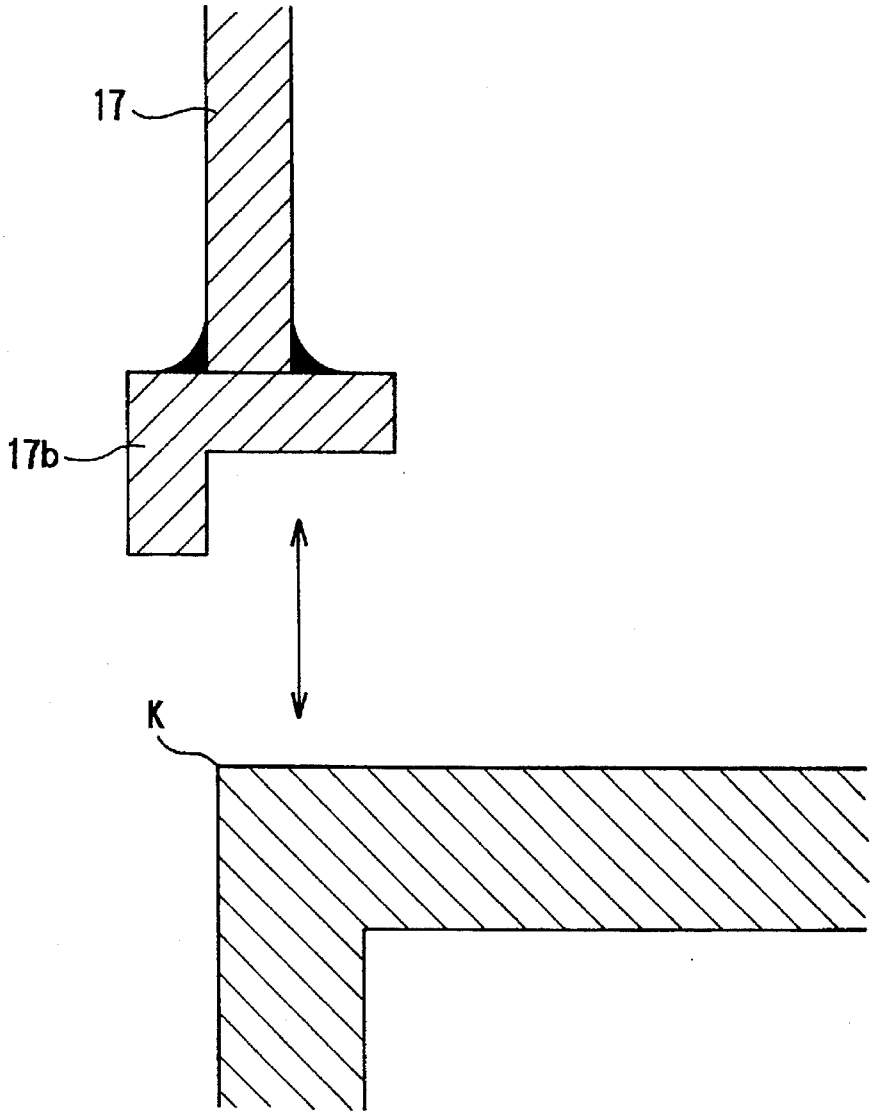
FIG. 4B is a cross-sectional view of the cover and a member to which the cover is attached.

FIG. 3 shows the cover 17 comprising a plurality of segments 17A, 17B, . . . 17I (nine segments). FIG. 4A shows a detailed structure of adjacent segments. As shown in FIG. 4A, a support 17S is fixed to the segment 17A by welding, and the segment 17B is held by the support 17S in such a state that a side edge of the segment 17B contacts a side edge of the segment 17A closely. FIG. 4B shows the cover 17 and a member to which the cover 17 is attached. As shown in FIG. 4B, a substantially L-shaped engagement member **17*b* is fixedly secured to a lower end of the cover 17 by welding. On the other hand, a member of the polishing apparatus has a corner portion k corresponding to the engagement member 17*b* so that the engage member 17*b* can be fitted over the corner portion k of the polishing apparatus. The abrasive cloth 22 on the turntable 12 is frequently replaced by a new cloth. In this embodiment, since the cover 17 comprises a plurality of segments 17A, 17B, . . . 17I, the required segments can be partly detached from the cover 17, and the abrasive cloth 22** can be promptly and easily replaced with a new one.

As shown in FIG. 1, a partition wall 26 is disposed below the turntable 12 to divide an interior space of the polishing apparatus 10 into an upper section, and a lower section for accommodating various mechanisms such as the motor 15. The exhaust duct 19 has a first opening 19*a* which is open toward the interior space of the cover 17 and is located below the abrasive cloth 22, a second opening 19*b* which is communicated with the lower section, and a third opening 19*c* which is open toward the interior space of the cover 18 which covers the moving mechanism 14. As a result, the space is divided into three spaces comprising a working space S1 defined in the covers 17 and 18 which cover the polishing section and the additional working sections including the loading section 31, the unloading section 32 and the top ring washing section 33, a buffer space S2 defined between the partition wall 20 and the cover 17, and an installation space (clean room) S3 of the polishing apparatus. The partition wall 20 has a door 20*a* which is mainly used for maintenance.

In the polishing apparatus of the above structure, the air inside the covers 17 and 18 and the partition wall 20 is discharged to the outside of the clean room C through the exhaust duct 19. Pressure inside the covers 17 and 18 and the partition wall 20 is lower than that in the clean room C in which the polishing apparatus 10 is installed. That is, negative pressure is generated in the covers 17 and 18 and the partition wall 20. Thus, the air in the clean room C is introduced into the buffer space S2 in the partition wall 20, flows from the buffer space S2 into the working space S1 inside the covers 17 and 18, and is discharged from the working space S1 to the outside of the clean room C through the exhaust duct 19. Therefore, a pollutant such as dust particles generated in the covers 17 and 18 is prevented from being scattered in the clean room C. Even if a small amount of pollutant is scattered in the buffer space S2 from the working space S1, such pollutant is not discharged from the buffer space S1 to the clean room C because the pressure in the buffer space S2 is lower than that in the clean room C.

According to this embodiment, inasmuch as the polishing section, the additional working sections including the loading section 31, the unloading section 32 and the top ring washing section 33 are integrally covered with the cover 17, and the pressure of the working space S1 defined in the cover 17 is lower than that of the surrounding space, dust particles, harmful gas and mist generated in the polishing section and dust particles and mist generated in the additional working sections are prevented from being scattered in the clean room C. Further, since the entire area of movement of the top ring 11 is covered with the cover 17 and the pressure in the cover 17 is lower than that of the surrounding space, abrasive liquid and particles which adhere to the top ring 11 are prevented from being scattered in the clean room C.

Further, according to this embodiment, since the entirety of the polishing apparatus 10 is enclosed within the partition wall 20, the space is divided into three spaces comprising the working space S1 defined in the cover 17 which covers the polishing section and the additional working sections, the buffer space S2 defined between the partition wall 20 and the cover 17, and the installation space (clean room) S3. The mist generated in the working space S1 is discharged directly from the working space S1 to the outside of the clean room C, and therefore such mist is not scattered in the buffer space S2 and does not stick to the inner surface of the partition wall 20. As a result, when replacing the abrasive cloth 22 with a new one, even if the door 20*a* of the partition wall 20 is opened and the cover 17 is detached, the mist which has been left in the cover 17 remains in the buffer space S2 which is a large space and is not scattered in the clean room C.

In this embodiment, since the first opening 19*a* of the exhaust duct 19 is located below the abrasive cloth 22, a down-draft of air is formed in the cover 17 as well as a descending current of mist. Therefore, the mist does not float in the cover 17 and is effectively discharged from the working space S1 to the outside of the clean room C. Further, since the cover 17 comprises a plurality of segments 17A, 17B, . . . 17I, the entirety of the cover 17 is not required to be detached for maintenance, and only a few segments which are required for maintenance can be detached.

Figure 5:
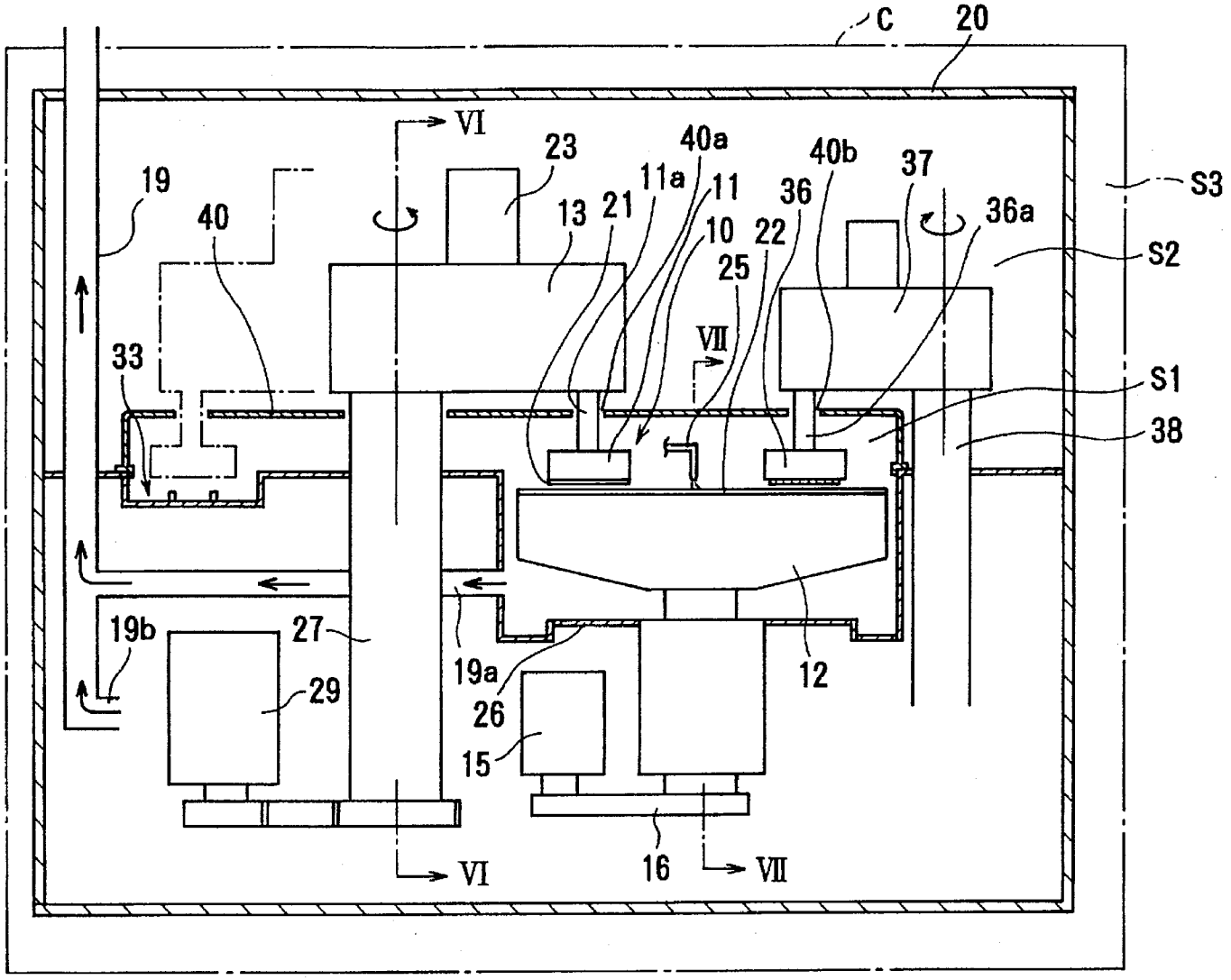
FIG. 5 is a schematic cross-sectional view of a polishing apparatus according to another embodiment of the present invention.

Next, a polishing apparatus according to the second embodiment of the present invention will be described below with reference to FIGS. 5 through 9. FIG. 5 is a schematic view showing the entire structure of the present invention. As shown in FIG. 5, a polishing apparatus 10 is installed in a clean room C. The polishing apparatus 10 is enclosed within a partition wall 20 which prevents gas and particles generated by a polishing operation from being scattered in the clean room C. The polishing apparatus 10 of FIG. 5 has substantially the same structure as the polishing apparatus of FIG. 1. However, the top ring 11 is not reciprocated linearly but is oscillated by swinging motion. That is, the top ring head 13 supporting the top ring 11 is coupled to a motor 29 for swinging the top ring 11, so that the top ring 11 is swingable around an axis of a main shaft 27. The loading section 31, the unloading section 32 and the top ring washing section 33 are disposed along a swinging trace of the top ring 11 (shown in FIG. 8).

Figure 7:
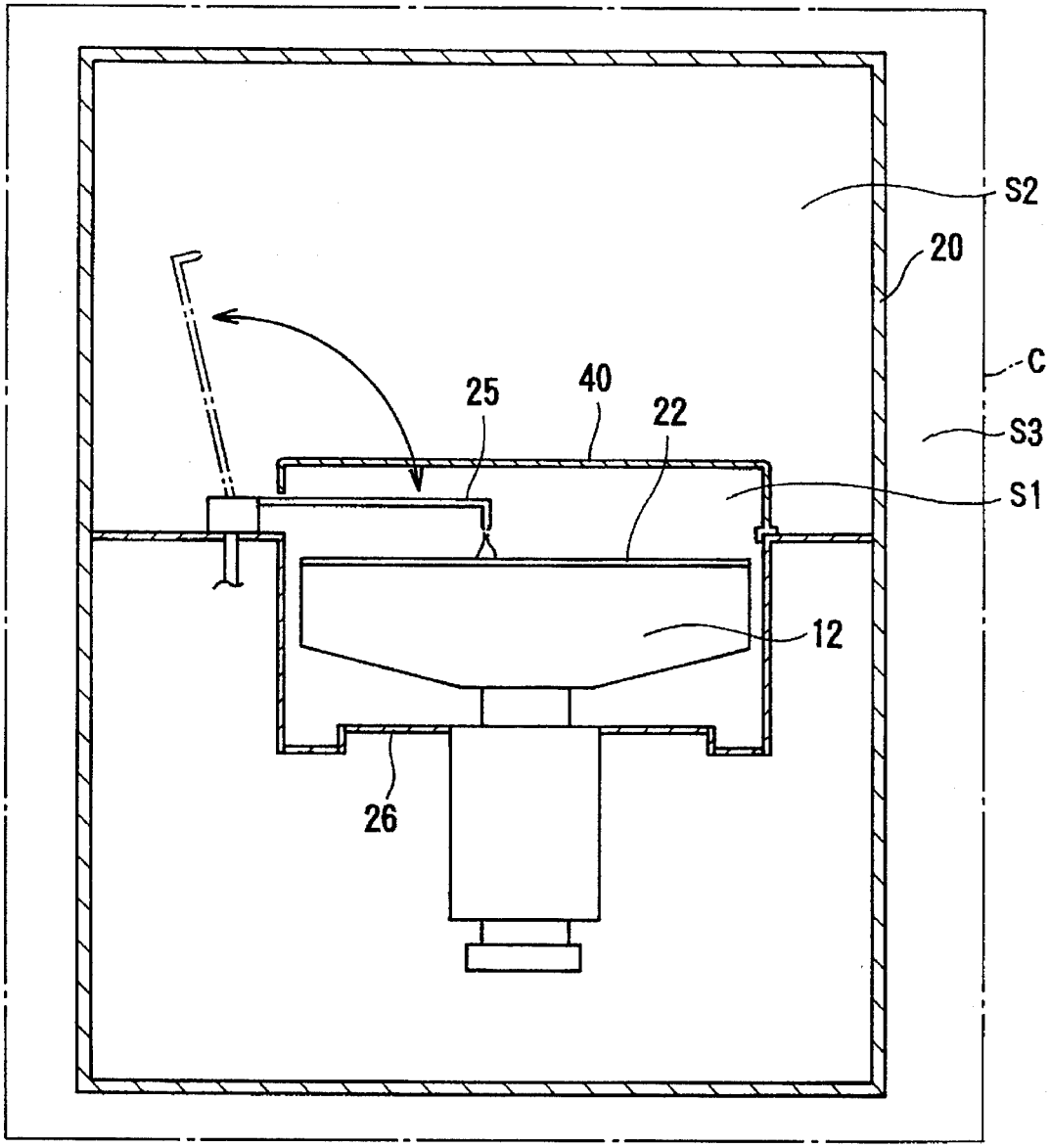
FIG. 7 is a cross-sectional view taken along line VII—VII of FIG. 5.

A rotating brush 36 for dressing the abrasive cloth 22 is disposed above the turntable 12. The rotating brush 36 is rotatable around its own axis by a driving mechanism 37. The rotating brush 36 is also rotatable around an axis of a supporting shaft 38 for supporting the rotating brush 36. Thus, the rotating brush 36 is swingable between the turntable 12 and a standby section 39 (shown in FIG. 8). A cover 40 is provided to cover the polishing section including the turn table 12, and the entirety of working sections comprising the loading section 31, the unloading section 32, the top ring washing section 33 and the standby section 39. FIG. 7 shows the relationship of the abrasive liquid nozzle 25 and the cover 40. After removing the cover 40, the abrasive liquid nozzle 25 is rotated around a base portion thereof as shown by imaginary lines.

Figure 8:
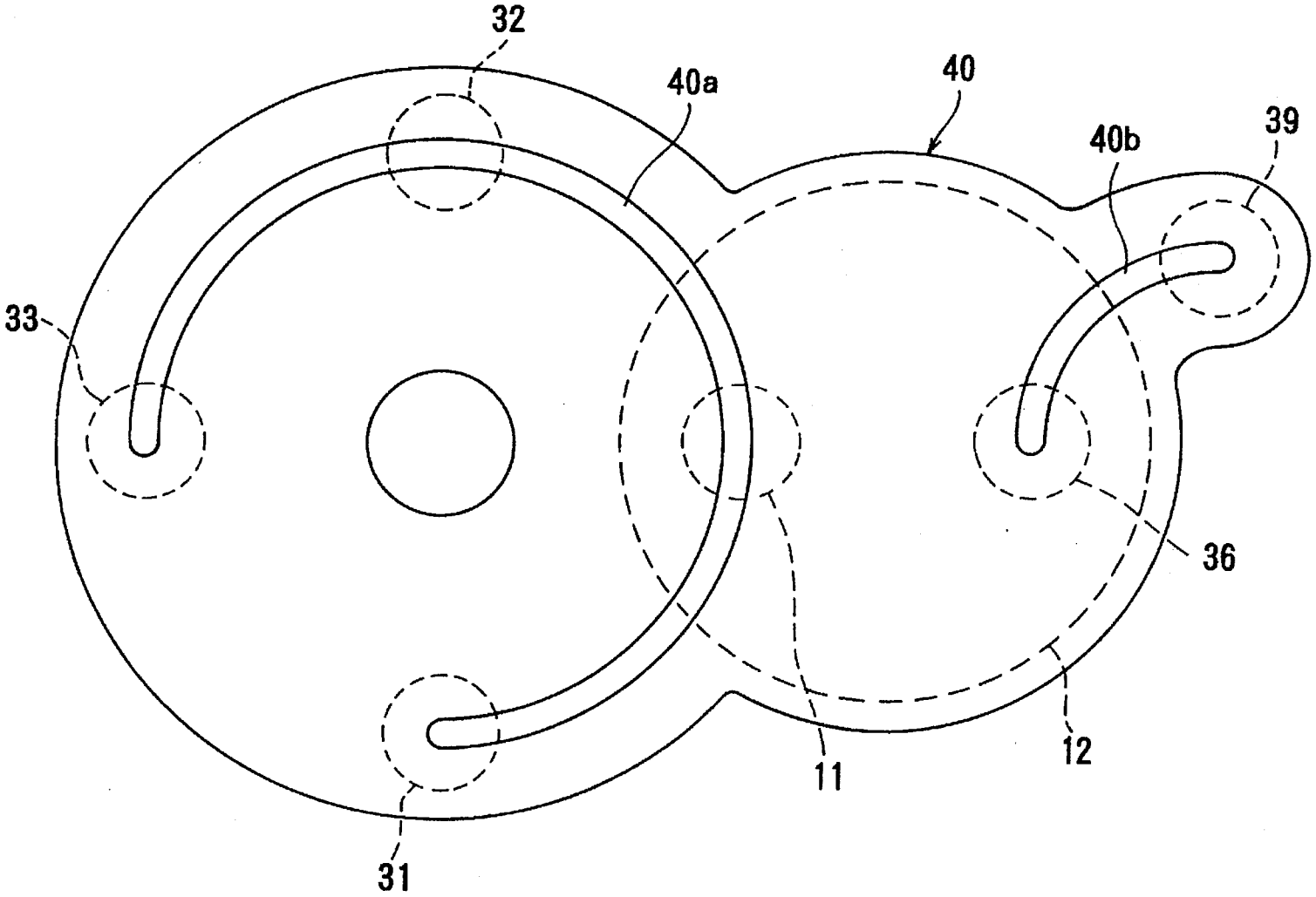
FIG. 8 is a plan view of a cover incorporated in the polishing apparatus of FIG. 5.

As shown in FIG. 8, the cover 40 is made of transparent resin material, comprises a plurality of segments and serves to cover working sections including the loading section 31, the unloading section 32 and the top ring washing section 33, the standby section 39 and the polishing section including the turntable 12. A circular or arcuate opening 40*a* is formed in the cover 40 to allow the top ring 11 to move circularly in the cover 40. A circular or arcuate opening 40*b* is also formed on the cover 40 to allow the rotating brush 36 to move circularly in the cover 40. The openings 40*a* and 40*b* have the respective widths that are slightly larger than the outside diameters of the top ring shaft 11*a* and a brush shaft 36*a* so that the top ring 11 can be oscillated in the cover 40 between the loading section 31 and the top ring washing section 33 and the rotating brush 36 can be oscillated in the cover 40 between the turntable 12 and the standby section 39.

As shown in FIG. 5, a partition wall 26 is disposed below the turntable 12 to divide an interior space of the polishing apparatus 10 into an upper chamber and a lower chamber for accommodating various mechanisms such as the motor 15. The exhaust duct 19 has a first opening 19*a* which is open toward the interior space of the cover 40 and is located below the abrasive cloth 22, and a second opening 19*b* which is communicated with the lower section. As a result, the space is divided into three spaces comprising a working space S1 defined in the cover 40 which covers the polishing section and the additional working sections including the loading section 31, the unloading section 32, the top ring washing section 33 and the dressing section, a buffer space S2 defined between the partition wall 20 and the cover 40, and an installation space (clean room) S3 of the polishing apparatus. The partition wall 20 has a door 20*a* which is mainly used for maintenance (see FIG. 6).

Figure 6:
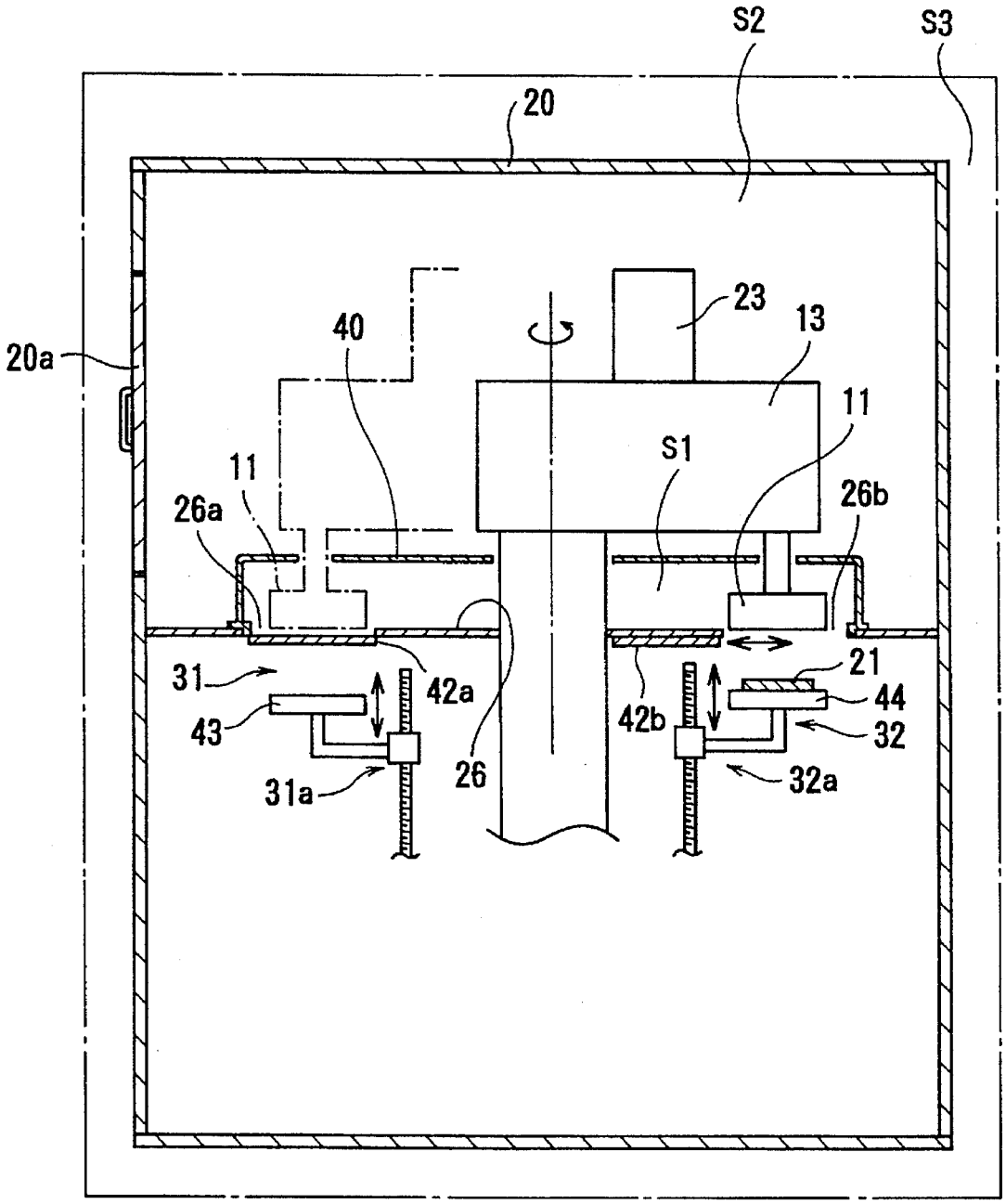
FIG. 6 is a cross-sectional view taken along line VI—VI of FIG. 5.

The partition wall 26 extends to the loading section 31 and the unloading section 32 as shown in FIG. 6. The loading section 31 and the unloading section 32 are partitioned by the partition wall 26 to define two spaces comprising an upper chamber and a lower chamber. The lower chamber houses driving mechanisms 31*a* and 32*a*. The partition wall 26 has two openings 26*a* and 26*b* for taking the semiconductor wafer 21 in and out of the working space S1, and shutters 42*a* and 42*b* are provided to allow the openings 26*a* and 26*b*, respectively, to be opened and closed.

Figure 9:
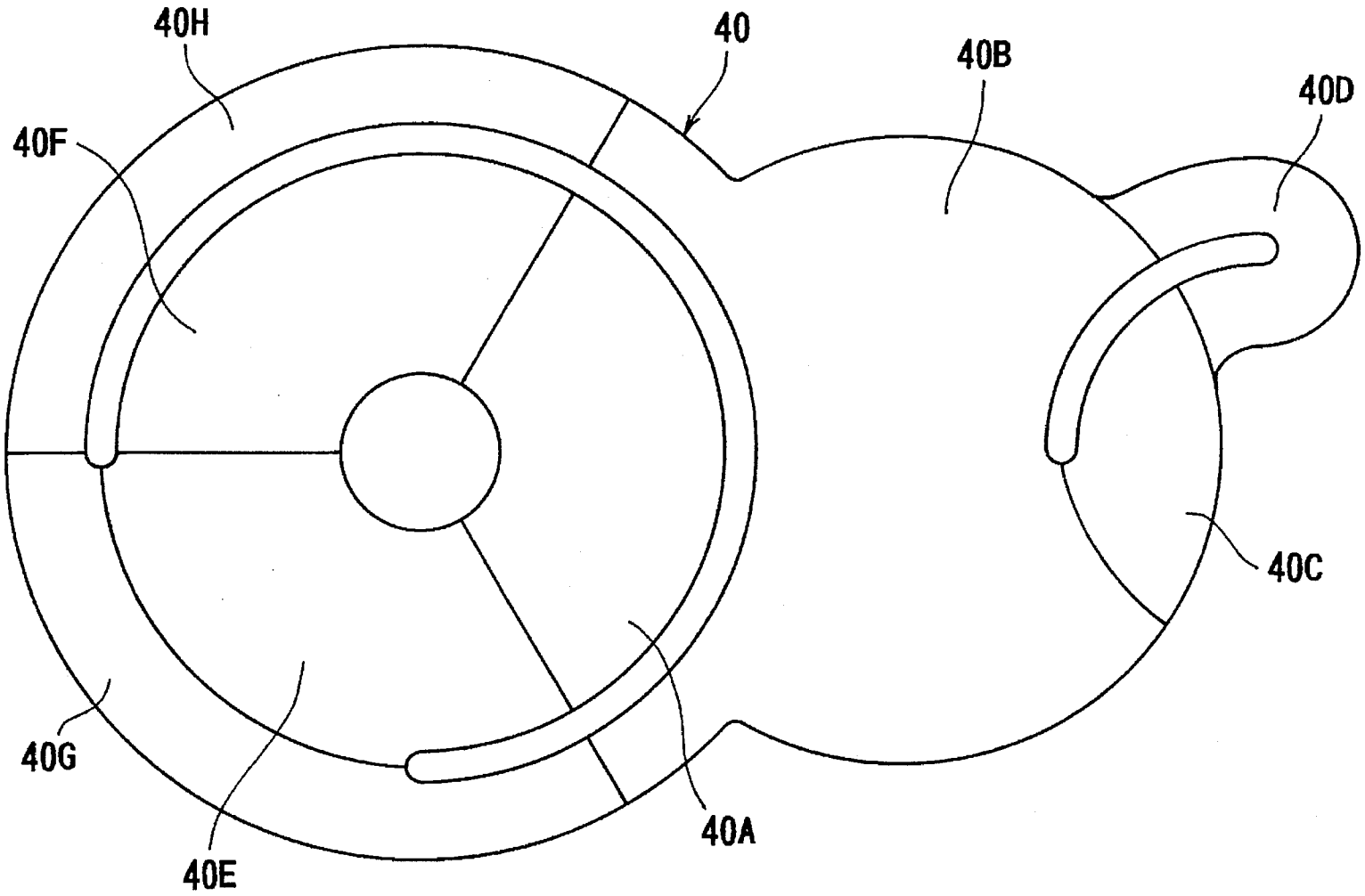
FIG. 9 is a plan view of the cover comprising a plurality of segments incorporated in the polishing apparatus of FIG. 5.

FIG. 9 shows the cover 40 comprising a plurality of segments 40A, 40B, . . . 40H (eight segments). When replacing the abrasive cloth 22 with a new one, only three segments 40A, 40B and 40C are detached from the cover 40.

Figure 10:
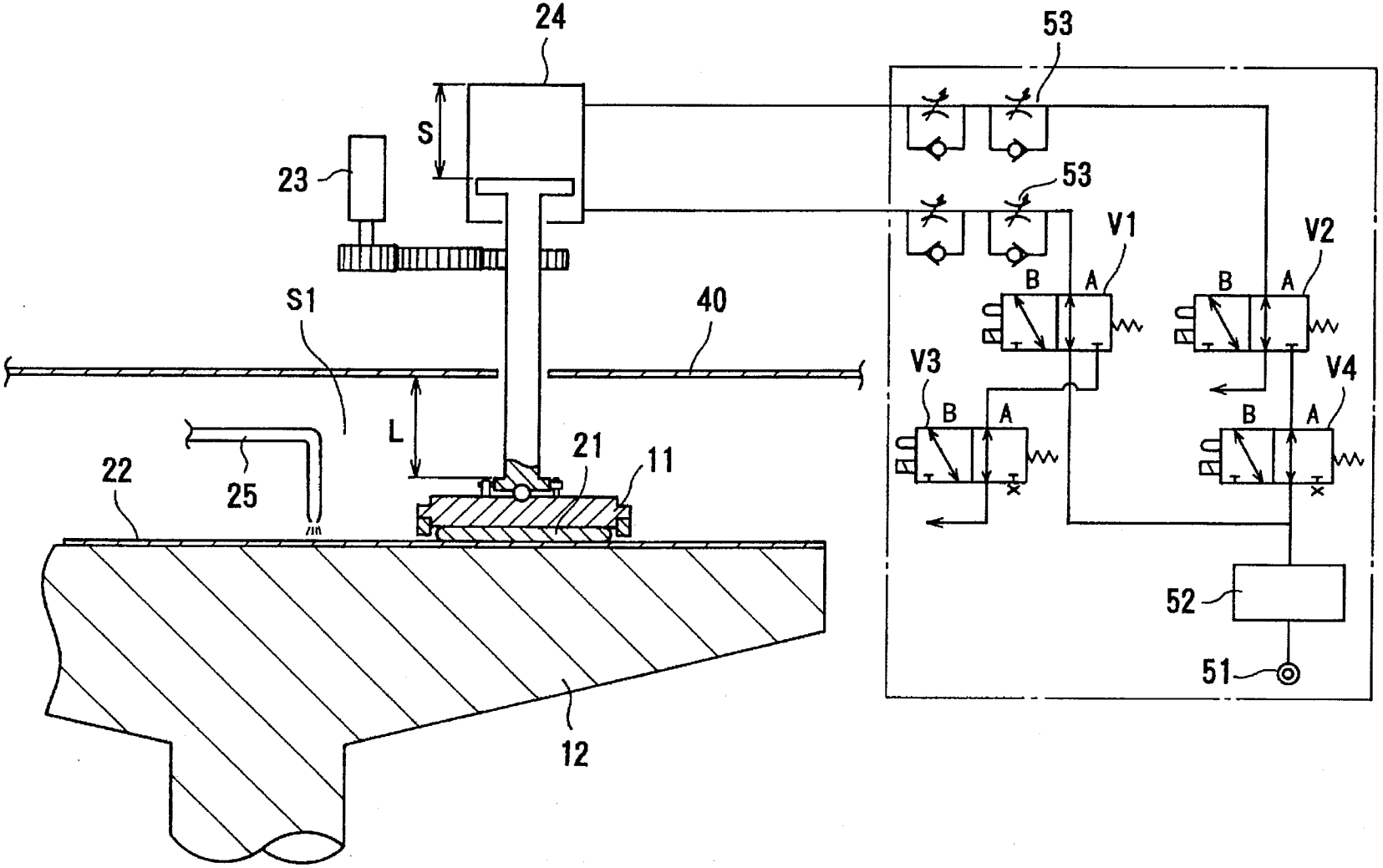
FIG. 10 is an air supply system of an air cylinder for moving a top ring incorporated in the polishing apparatus of FIG. 5.

FIG. 10 shows an air supply system for the top ring air cylinder 24 serving as pressing means of the top ring 11. The air supply system comprises a compressed air source 51, an electromagnetic regulator 52, two way type valves V1–V4 and orifices 53. The electromagnetic regulator 52 functions to change air pressure output therefrom on the basis of an electric signal. The valves V1–V4 each have two ports A and B, and a fluid passage can be changed by selecting one of the ports A and B on the basis of an electric signal. In the valves V1–V4 of this embodiment, the port A is selected when an electric signal is not input to the respective valve. The orifices 53 function to adjust air flow rate to adjust a speed of movement of a piston of the top ring air cylinder 24.

When pressing the top ring 11 against the turntable 12, air pressure output from the electromagnetic regulator 52 is set at a predetermined value and the port B is selected in each of valves V1 and V2. Air pressure is applied to an upper chamber of the air cylinder 24 to lower the top ring 11. When lowering the top ring 11 from an upper position thereof onto the turntable 12, the air pressure output from the electromagnetic regulator 52 is lower than during a polishing operation. When the top ring 11 moves toward the other working sections, the port B is selected in each of the valves V1–V4 and air is confined in the cylinder chambers of the air cylinder 24. When electric signals supplied to the valves V1–V4 are cut off at a power failure or shutdown of the polishing apparatus, the port A is selected in each of the valves V1–V4, and the top ring 11 is lifted up to the uppermost position. At this time, the stroke S of the piston of the top ring air cylinder 24 is shorter than the distance L between the upper surface of the top ring 11 and the cover 40, and thus the top ring 11 does not contact the cover 40. The electromagnetic regulator 52 can change air pressure output therefrom during a polishing operation, so that a pressing force for pressing the top ring 11 against the abrasive cloth 22 can be changed during the polishing operation.

The entire operation of the polishing apparatus will now be described below. As shown in FIG. 6, in the loading section 31, the semiconductor wafer 21 to be polished is loaded onto the top ring 11. A pusher 43 of the loading section 31 which supports the semiconductor wafer 21 having a lower surface to be polished is lifted, and the shutter 42*a* is opened. When the semiconductor wafer 21 on the pusher 43 is brought into contact with the top ring 11, the semiconductor wafer 21 is attached under vacuum to the lower surface of the top ring 11. Thereafter, the pusher 43 is lowered, and the shutter 42*a* is closed. The top ring 11 holding the semiconductor wafer 21 moves to the turntable 12, and is lowered to press the semiconductor wafer 21 against the abrasive cloth 22. At this time, the turntable 12 is rotated, and the top ring 11 is rotated around its own axis. Further, the abrasive liquid is supplied from the abrasive liquid nozzle 25 onto the abrasive cloth 22 (see FIG. 5). The semiconductor wafer 21 is polished in contact with the abrasive material on the abrasive cloth 22. After polishing, the top ring 11 is moved to the unloading section 32 to unload the semiconductor wafer 21. As shown in FIG. 6, a table 44 of the unloading section 32 is lifted, the shutter 42*b* is opened, and the upper surface of the table 44 contacts the semiconductor wafer 21. At this time, vacuum is released in the top ring 11, and fluid is ejected from the lower surface of the top ring 11, whereby the semiconductor wafer 21 is disengaged from the top ring 11 and placed on the table 44. Thereafter, the table 44 is lowered, the shutter 42*b* is closed, and unloading operation is finished. The top ring 11 from which the semiconductor wafer 21 is unloaded moves to the top ring washing section 33, and is washed to remove abrasive liquid therefrom.

The polishing apparatus of this embodiment offers the same advantages as those of the first embodiment of FIGS. 1 through 4. Further, in this embodiment, since the cover 40 covers the area for performing dressing of the abrasive cloth 22 and air pressure in the cover 40 is lower than that of the surrounding space, mist generated by the dressing operation is not scattered in the clean room C.

Further, according to this embodiment, the shutters 42*a* and 42*b* are provided in the loading and unloading sections 31 and 32, respectively, to prevent mist in the cover 40 from adhering to equipment at the loading and unloading sections 31 and 32. Since air pressure in the cover 40 is lower than that in the loading and the unloading sections 31 and 32, mist is prevented from flowing toward the equipment at the loading and the unloading sections 31 and 32.

Figure 11:
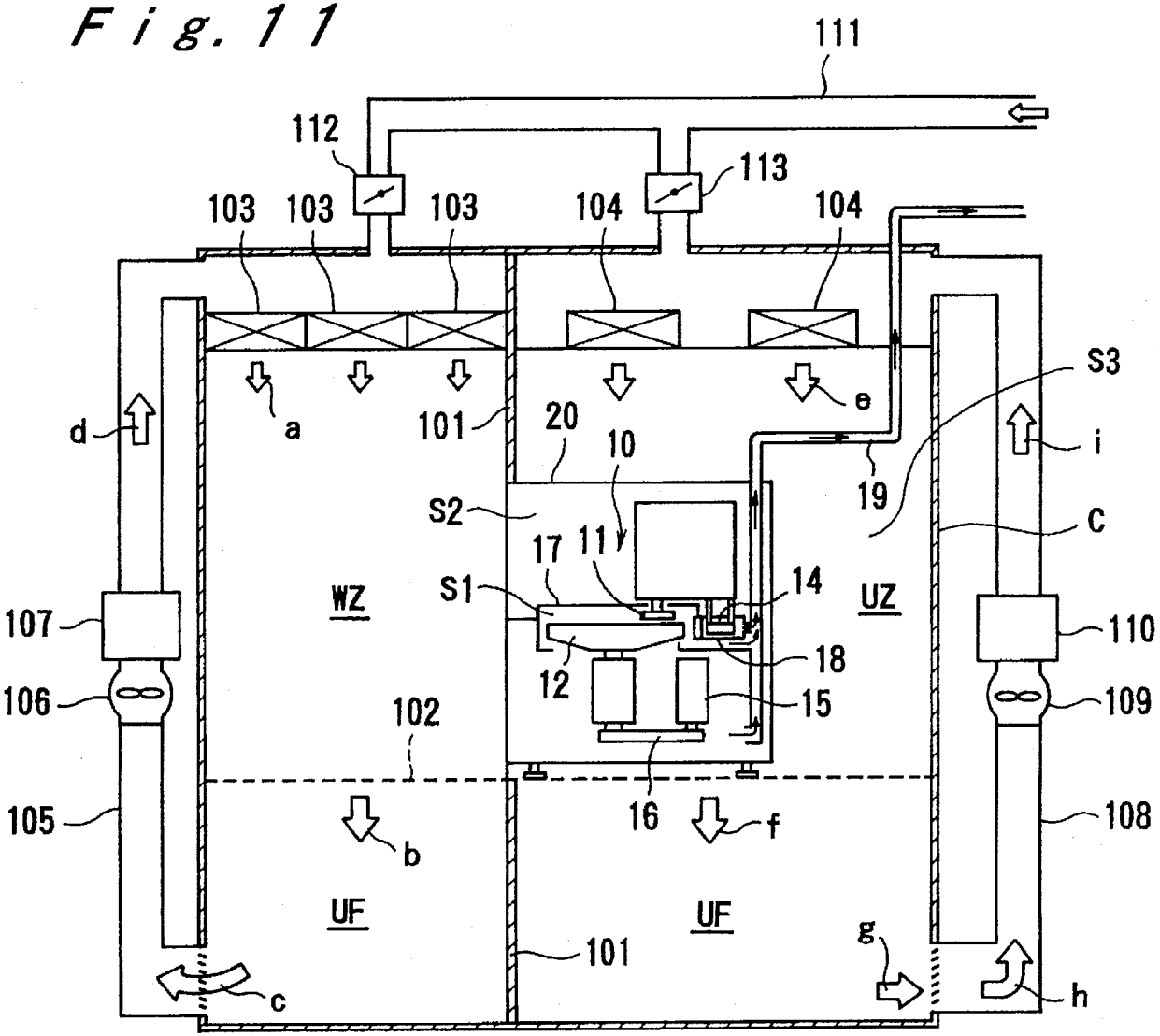
FIG. 11 is a schematic cross-sectional view of the polishing apparatus of FIG. 1 installed in a clean room.

FIG. 11 shows the polished apparatus 10 of FIG. 1 which is installed in the clean room C. The clean room C is divided by a screen-like floor 102 into two spaces comprising a lower chamber UF and an upper chamber. The upper chamber is partitioned by a partition 101 into a working zone WZ and a utility zone UZ. HEPA (High Efficiency Particulate Air) filters 103 are disposed at the ceiling of the working zone WZ, and HEPA filters 104 are disposed at the ceiling of the utility zone UZ. The air in the working zone WZ is circulated through the lower chamber UF, a duct 105, a fan 106, an air conditioner 107 and the HEPA filters 103 as shown by arrows a, b, c and d. The air in the utility zone UZ is also circulated through the lower chamber UF, a duct 108, a fan 109, an air conditioner 110 and the HEPA filters 104 as shown by arrows e, f, g, h, and i. The polishing apparatus 10 is installed on the floor 102 of the utility zone UZ. The exhaust duct 19 extends from the interior of the polishing apparatus 10 to the outside of the clean room C. The air inside the cover 17, the cover 18 and the partition wall 20 is discharged to the outside of the clean room C through the exhaust duct 19 by a fan (not shown). The air pressure in the cover 17, the cover 18 and the partition wall 20 is lower than that in the working zone WZ and the utility zone UZ. Therefore, the air in the clean room (the working zone WZ and the utility zone UZ) C is introduced into the buffer space S2 in the partition wall 20 which covers the entirety of the polishing apparatus 10, and then flows from the buffer space S2 to the working space S1. Thereafter, the air in the working space S1 is discharged to the outside of the clean room C through the exhaust duct 19.

A duct 111 is provided to take a quantity of air corresponding to the quantity of air discharged from the clean room C through the exhaust duct 19 into the clean room C. The air is supplied into the working zone WZ and the utility zone UZ through the duct 111 and the HEPA filters 103 and 104. The quantity of air to be supplied into the clean room C is adjusted by dampers 112 and 113.

As is apparent from the above description, according to the present invention, inasmuch as the polishing section, the additional working sections including the loading section and the unloading section are integrally covered with the cover, and the pressure of the working space defined in the cover is lower than that of the surrounding space dust particles, harmful gas and mist generated in the polishing section and dust particles and mist generated in the additional working sections are prevented from being scattered in the clean room. Further, since the entire area of movement of the top ring is covered with the cover and the pressure in the cover is lower than that of the surrounding space, abrasive liquid and particles which adhere to the top ring are prevented from being scattered in the clean room.

Further, according to the present invention, since the entirety of the polishing apparatus is enclosed within the partition wall, the space is divided into three spaces comprising the working space defined in the cover which covers the polishing section and the additional working sections, the buffer space defined between the partition wall and the cover, and the installation space of the polishing apparatus. The mist generated in the working space is discharged directly from the working space to the outside of the clean room, and therefore such mist is not scattered in the buffer space and does not stick to the inner surface of the partition wall. As a result, when replacing the abrasive cloth with a new one, even if the door of the partition wall is opened and the cover is detached, such mist which has been left in the cover remains in the buffer space having a large space and is not scattered in the clean room.

Furthermore, according to the present invention, since the cover covers the area for performing dressing of the abrasive cloth, and air pressure in the cover is lower than that of the surrounding space, mist generated by the dressing operation is not scattered in the clean room.

Further, according to the present invention, since the exhaust duct has an opening which is located below the abrasive cloth, a down-draft of air is formed in the cover as well as a descending current of mist. Therefore, the mist does not float in the cover and is effectively discharged from the working space to the outside of the clean room.

Although certain preferred embodiments of the present invention have been shown and described in detail, it should be understood that various changes and modification may be made thereto without departing from the scope of the appended claims.

What is claimed is:

1. A polishing apparatus for polishing a surface of a workpiece, said apparatus comprising:

a polishing section having a turntable with an abrasive cloth mounted on an upper surface thereof;

a top ring for supporting the workpiece to be polished and pressing the workpiece against said abrasive cloth, said top ring being movable vertically and horizontally;

a loading section disposed adjacent to said polishing section for loading the workpiece to be polished onto said top ring;

an unloading section disposed adjacent to said polishing section for unloading the workpiece which has been polished from said top ring;

a cover extending over substantially the entire area of movement of said top ring, said polishing section, said loading section and said unloading section; and an exhaust duct for discharging air of an interior space of said cover to an outside of an installation space of said polishing apparatus and allowing pressure of said interior space to be lower than that of said installation space.

2. The polishing apparatus according to claim 1, further comprising a washing section for washing said top ring, and wherein said top ring is movable to said washing section, and said washing section is covered by said cover.

3. The polishing apparatus according to claim 1, further comprising a dressing device for dressing said abrasive cloth, and wherein said dressing device is movable between said turntable and a standby section adjacent to said turntable, and substantially the entire area of movement of said dressing device including said turntable and said standby section is covered by said cover.

4. The polishing apparatus according to claim 1, further comprising a partition wall enclosing the polishing apparatus, and wherein said exhaust duct is communicated with an interior space of said partition wall.

5. The polishing apparatus according to claim 1, wherein said exhaust duct has a suction opening which is located below said abrasive cloth so that a down-draft of air is formed within said cover.

6. The polishing apparatus according to claim 1, wherein said cover comprises a plurality of segments which are detachable independently of each other.

7. The polishing apparatus according to claim 1, wherein said cover has an opening through which a shaft of said top ring passes, and said opening extends along a moving trace of said shaft so that said top ring is movable in said cover.

8. The polishing apparatus according to claim 1, further comprising a partition wall which partitions said loading section into an upper space and a lower space, and wherein loading equipment is provided in said lower space, and said partition wall has an opening which is closable by a shutter.

9. The polishing apparatus according to claim 1, further comprising a partition wall which partitions said unloading section into an upper space and a lower space, and wherein unloading equipment is provided in said lower space, and said partition wall has an opening which is closable by a shutter.

* * * * *